US006700983B1

(12) United States Patent
Bøgeskov-Jensen et al.

(10) Patent No.: US 6,700,983 B1
(45) Date of Patent: Mar. 2, 2004

(54) HEARING AID

(75) Inventors: Tom Bøgeskov-Jensen, Hellerup (DK); Bent Severin, Hellerup (DK); Jesper Bach Nørgård, Hellerup (DK)

(73) Assignee: Oticon A/S, Hellerup (DK)

( * ) Notice: Subject to any disclaimer, the term of this patent is extended or adjusted under 35 U.S.C. 154(b) by 0 days.

(21) Appl. No.: 09/806,998

(22) PCT Filed: Oct. 7, 1999

(86) PCT No.: PCT/DK99/00533

§ 371 (c)(1),
(2), (4) Date: May 17, 2001

(87) PCT Pub. No.: WO00/21334

PCT Pub. Date: Apr. 13, 2000

(30) Foreign Application Priority Data

Oct. 7, 1998 (DK) ..... 1998 01268

(51) Int. Cl.[7] ..... H04R 25/00
(52) U.S. Cl. ..... 381/322; 381/324; 381/330
(58) Field of Search ..... 381/312, 322, 381/324, 327, 330, 381

(56) References Cited

U.S. PATENT DOCUMENTS 4,354,065 A * 10/1982 Buettner ..... 381/330
5,062,138 A * 10/1991 Schmid ..... 381/330
5,204,917 A * 4/1993 Arndt et al. ..... 381/330
6,041,128 A * 3/2000 Narisawa et al. ..... 381/330

* cited by examiner

*Primary Examiner*—Suhan Ni
(74) *Attorney, Agent, or Firm*—Dykema Gossett PLLC

(57) ABSTRACT

A hearing aid includes a housing and a hook, the housing defining a top area and a bottom area, a front end and a rear end, and contains a microphone, an amplifier, a receiver, and a battery for power supply, and the hook is attached to the housing and transmits acoustic signals from the receiver into the ear of the user. The housing is provided by two connectable and detachable parts having lines of separation extending at least partly between top and bottom at both sides of the housing between the front end and the rear end, and means are provided in the front part for holding an amplifier circuitry board at one edge.

6 Claims, 11 Drawing Sheets

HEARING AID

BACKGROUND OF THE INVENTION

The invention relates to a hearing aid comprising a housing containing a microphone, an amplifier, a receiver and a battery for power supply, the housing comprising a front end and a rear end, a top area and a bottom area, where at the top area a hook is placed for transmittal of acoustic signals from the receiver into the ear of the user.

Such hearing aids are well known within the art as so-called BTE hearing aids. The front end is the end, which abuts the ear of the user. The manufacturing of such hearing aids is normally carried out by a manual assembling process. It is obvious that the assembling process is a cost and time-consuming process, as the many tiny parts require a significant accuracy.

Usually the hearing aid of this type comprises a housing, which has lines of separation extending at the front end and at the rear end. This type of housing makes the assembling process rather cumbersome and time consuming since the inner housing is poorly accessible. This means that the initial price of the hearing aid becomes high as well as the cost of the subsequent repair necessitating a separation of the two housing parts.

A further previously known hearing aid comprises a frame, which carries the operating parts of the hearing aid. It is clear that such a frame applies more weight to the hearing and therefore in undesirable.

The objective of the present invention is to provide a hearing aid, which facilitates the assembling process and furthermore makes an at least partly automated assembly possible without increasing the weight of the hearing aid.

SUMMARY OF THE INVENTION

According to the invention this is obtained by a hearing aid of the type described in the introductory part of the description and which is characterized in that the housing comprises two connectable and detachable parts having lines of separation extending at least partly between top and bottom at both sides of the housing between the front area and the rear area, where in the front part means are provided for holding at least the amplifier circuitry board.

Since the front part is separated as suggested and since this part comprises means for holding the microphone, the amplifier and the receiver it has been made possible to access the holding means much easier using manual assembly methods and also using automated assembly machinery such as industrial robots. The result of this is a significant decrease in time consuming by manual assembly hereby obtaining a more cost effective assembly process and furthermore the possibility of using a assembly machinery hereby also obtaining a more cost effective assembly. In both cases the final product will be producible with lower costs hereby increasing the competiveness of the hearing aid. The self-sustaining character of the hearing aid housing maintains the desirable low weight.

In a preferred embodiment part further comprises means for holding the microphone possibly in a microphone suspension.

In a further preferred embodiment the front part further comprises means for holding the receiver, possibly in a receiver suspension.

Preferably the means for holding the circuitry board comprises at least one slot for receiving a side edge of the circuitry board. A further possibility consist in that the front part comprises mutually separated protruding holding means for receiving a side edge of the circuitry board.

The rear part is adapted to hold the side edge opposite the one received in the front part.

The invention will be explained more detailed in the following with reference to the drawings.

DESCRIPTION OF A PREFERRED EMBODIMENT

Figure 1:
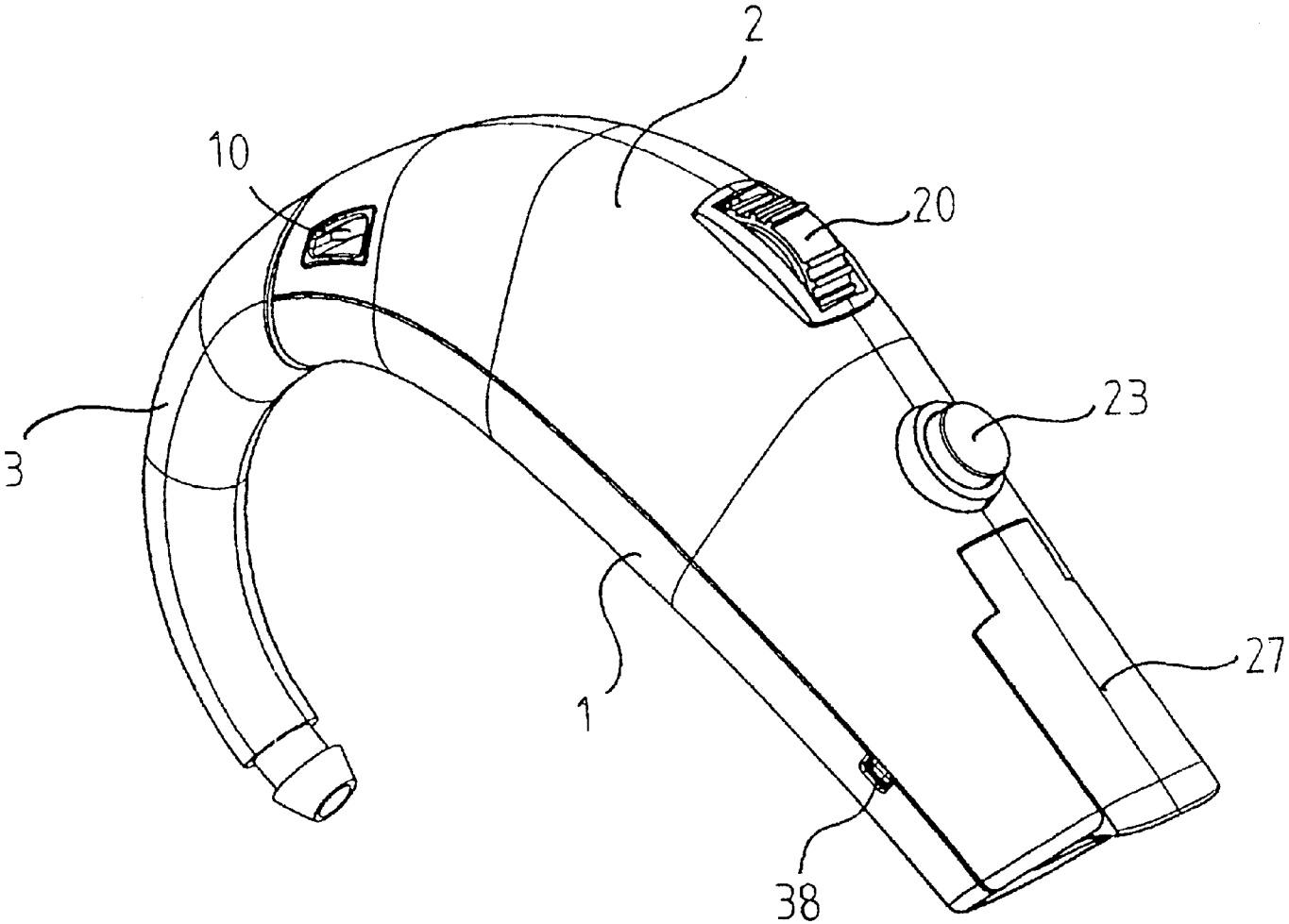
FIG. 1 is a perspective view of a BTE hearing aid according to the invention.

From FIG. 1 a hearing aid is shown which includes a housing divided into two shell parts, a first shell part 1 and a second shell part 2. At the upper end of the housing a hook 3 is mounted in an adapter part. An acoustic inlet opening 10 appears as well as a volume control 20, an activating button 23 and a battery drawer 27. An aperture 38 for accessing a battery terminal appears.

Figure 2:
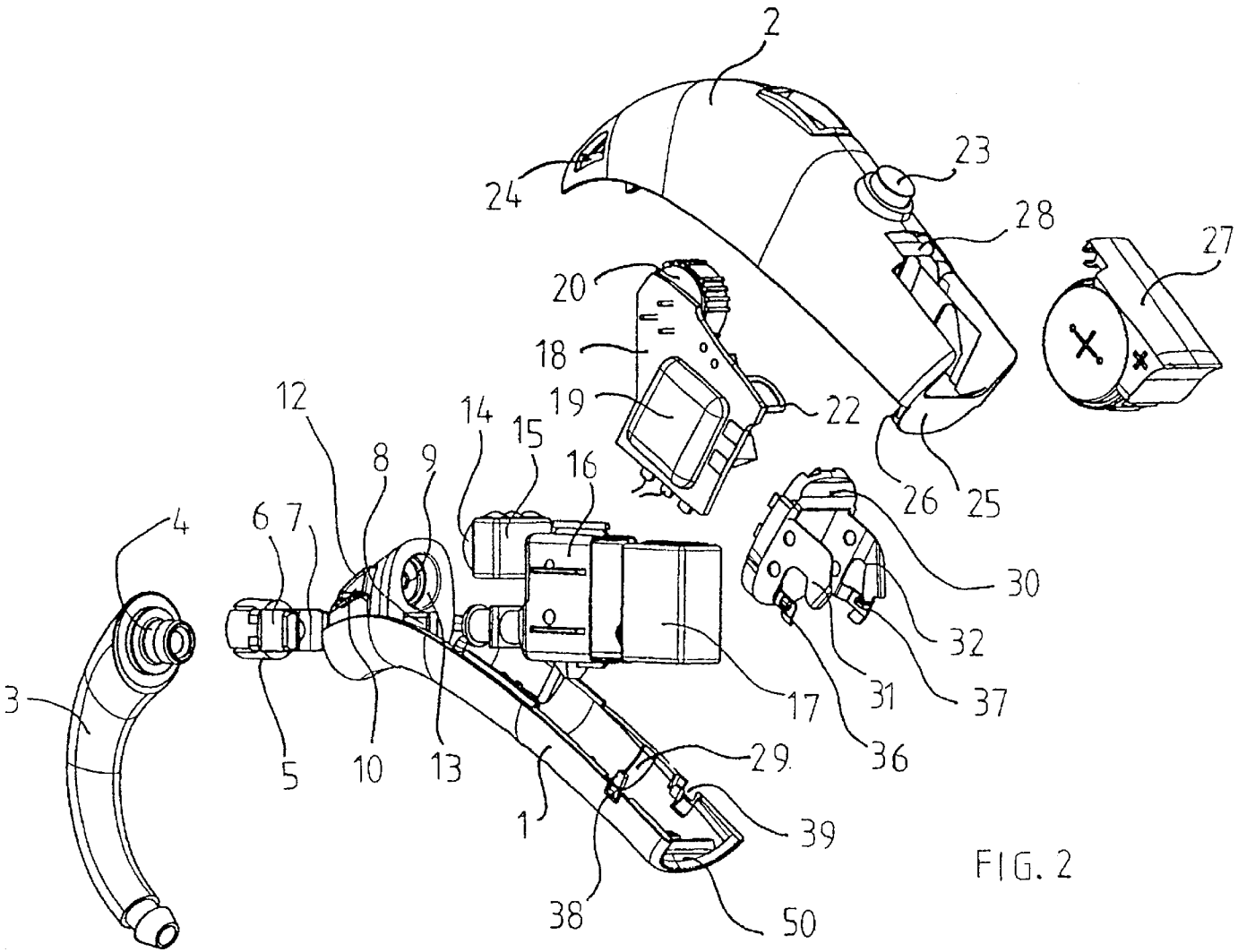
FIG. 2 is an exploded view of the hearing aid shown in FIG. 1.

From FIG. 2 an exploded view of the hearing aid shown in FIG. 1 appears. The hook 3 comprises a circumferential recess 4 at the coupling end. It appears that the hook is mounted in an adapter part 5, which is mounted in an aperture in the first shell part 1 and is held in place by means of two flexible legs 6,7 having at their outer ends barbs cooperating with internal shoulders around the aperture 8 in the first shell part. The opposite end of the adapter 5 comprises four flexible wall parts separated by incisions and having internal barbs adapted to cooperate with the recess 4 in the hook 3.

The first shell part comprises an acoustic inlet channel which at the outer end is branched into two opposed acoustic inlet openings 10,11 located at the sides of the first shell part. A thin protruding wall 12 surrounds each inlet opening. At the inner end the channel faces a cavity 13 for holding a microphone suspension 14 which holds the microphone 15. Beneath the cavity 13 for holding the microphone suspension and the microphone the above-mentioned aperture 8 for the hook adapter is situated. A receiver 17 is adapted to be placed in a receiver suspension 16, which is inserted into the aperture and into the adapter. The outer end of the suspension forms a seal against the hook 3 when this is mounted in the hook adapter.

In the first shell part holding means are provided for receiving and holding a circuitry board 18 which on its side holds an amplifier 19, a volume control 20, a telecoil (not visible), programming terminals 21 and a switch 22 adapted to be activated by the activating button 23. These holding means comprise holding slots 33,34 (see FIG. 3) for the end areas of the board at one side edge of this. This means that the board is fixed in transversal as well as longitudinal translation and may only be inserted and removed in a direction parallel to the board plane. Between the slots apertures 49 for the programming terminals on the circuitry board are provided for allowing access to these from the outer surface of the housing. At the end of the first shell part a locking recess 50 is provided. A recess 29 is provided for receiving a terminal wall 30 being provided with terminals 31,32 for contacting the battery and further terminal 36,37 for external access through apertures 38,39.

The second shell part comprise apertures 24 for receiving and surrounding the protruding walls 12 around the acoustic inlets 10,11 on the first shell part. At the opposite end of the second shell part a locking arm 25 having a barb 26 is provided. This locking arm 25 and the barb 26 together with the apertures 24 at the opposite end of the second shell part and the protruding wall 12 and the locking recess 50 on the first shell part forms the releasable locking means of the two shell parts. In the second shell part the battery drawer is mounted to be pivotable around a shaft 28. The two shell parts may be dismantled using a tool which comprises two arms adapted to be inserted between the first and the second shell part in the area where these are mutually connected at the acoustic inlets. Upon insertion the second shell part will be expanded to a state where this may be lifted away from the protruding wall parts and hereby may be released from the first shell part.

Figure 3:
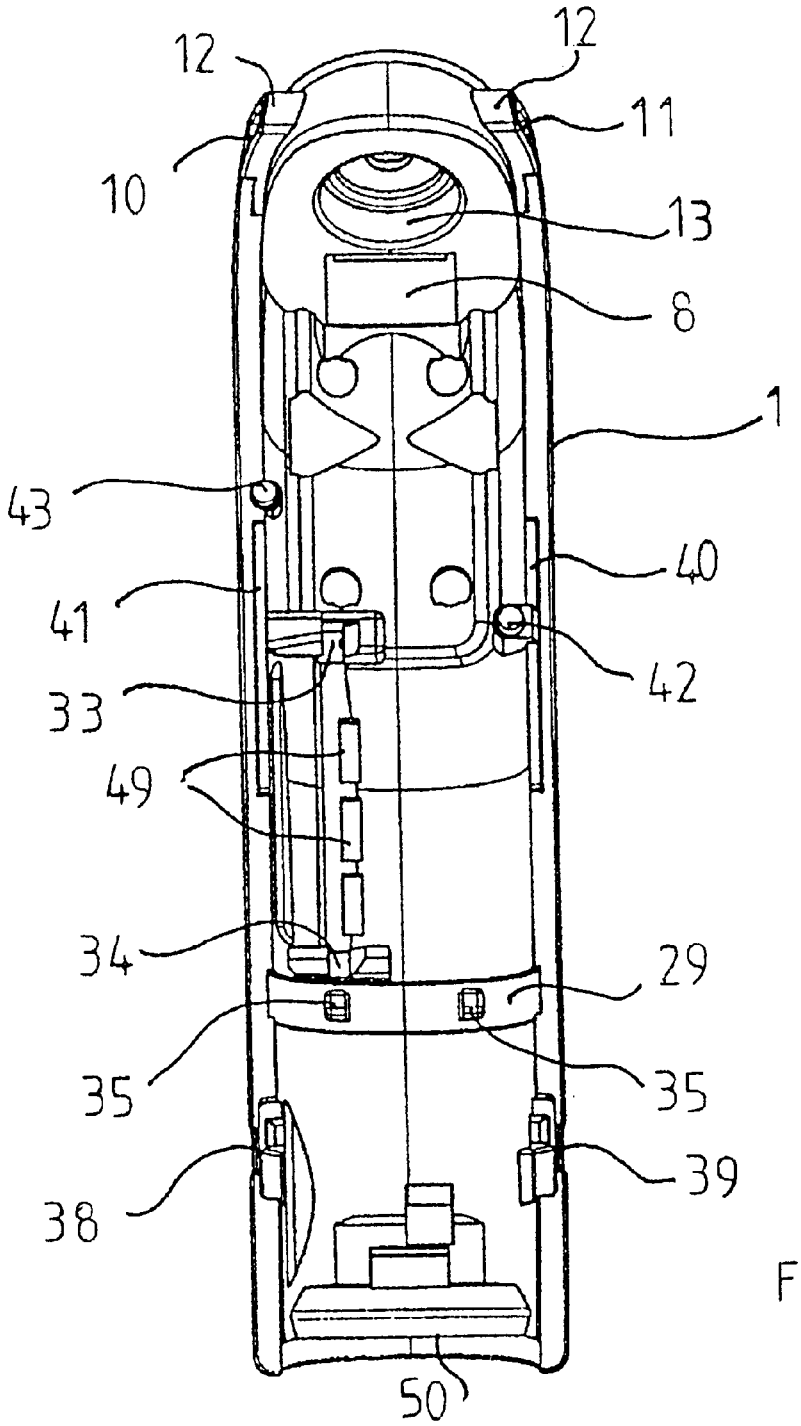
FIG. 3 is a top view of the front part of the housing.

From FIG. 3 the wall elements 12 surrounding the inlet openings 10,11 appear. It appears that the lower edge of the wall element will retain the second shell part against an upward directed movement. At the opposite end of the first shell part a recess 50 is provided, which is adapted for receiving a barb 26 on an arm 25 of the second shell part. Furthermore guide rails 40,41 on the first shell part appear as well as stays 42,43 for increasing the rigidity of the construction, especially against pressure from the side. These elements 40–43 cooperate with apertures or recesses 44–47 in the second shell part. Guide taps for the terminal wall in the recess 29 appears as well.

Figure 4:
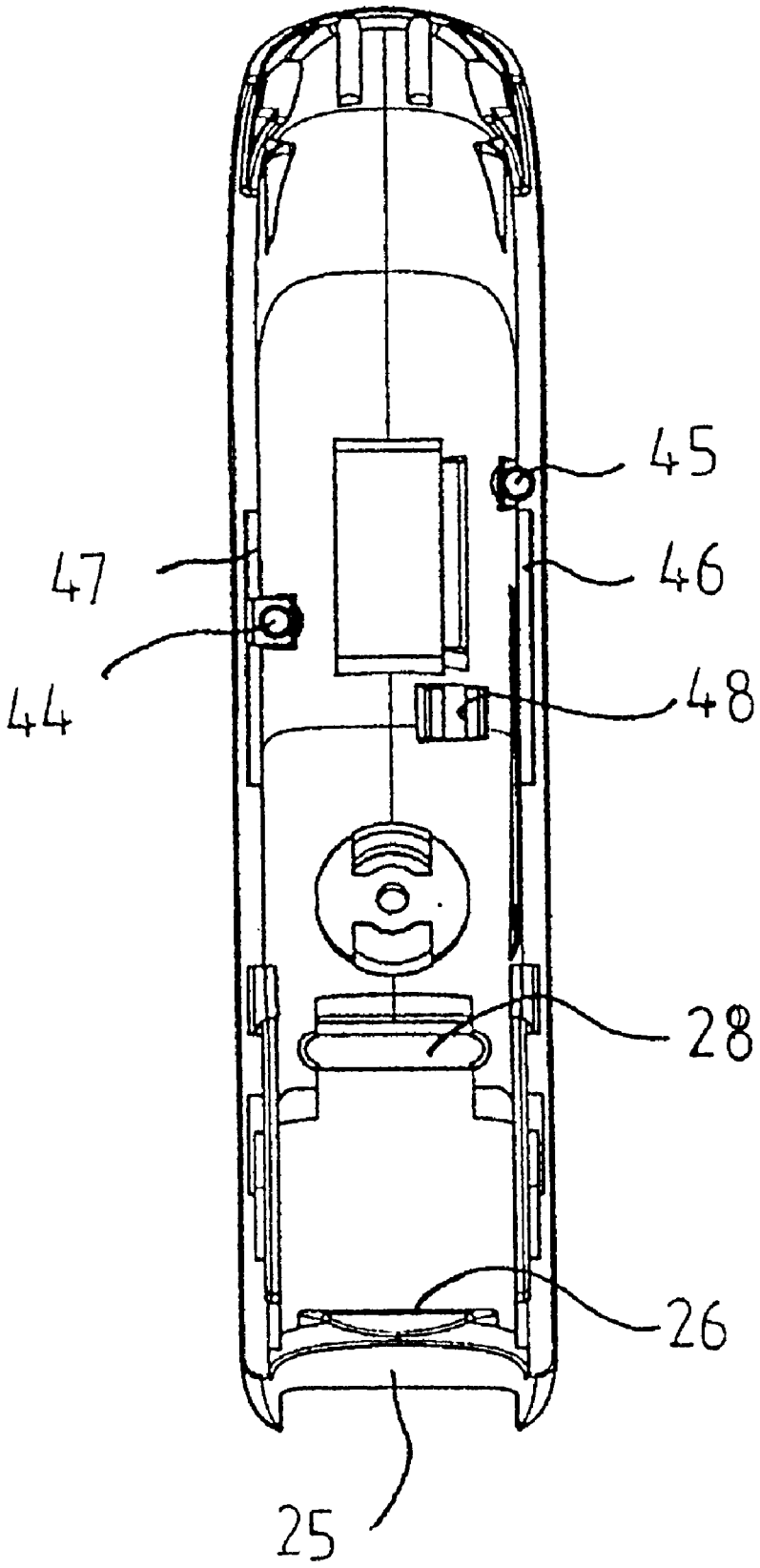
FIG. 4 is a bottom view of the rear part of the housing.

From FIG. 4 the arm 25 with the locking barb 26 appears. Furthermore the holes 44,45 for receiving the stays of the first shell part appears as well as the recesses 46,47 for receiving the guide rails of the first shell part. Furthermore a holding means 48 for holding the circuitry board at a side edge opposite the one held in the first shell part is provided in the second shell part.

Figure 5:
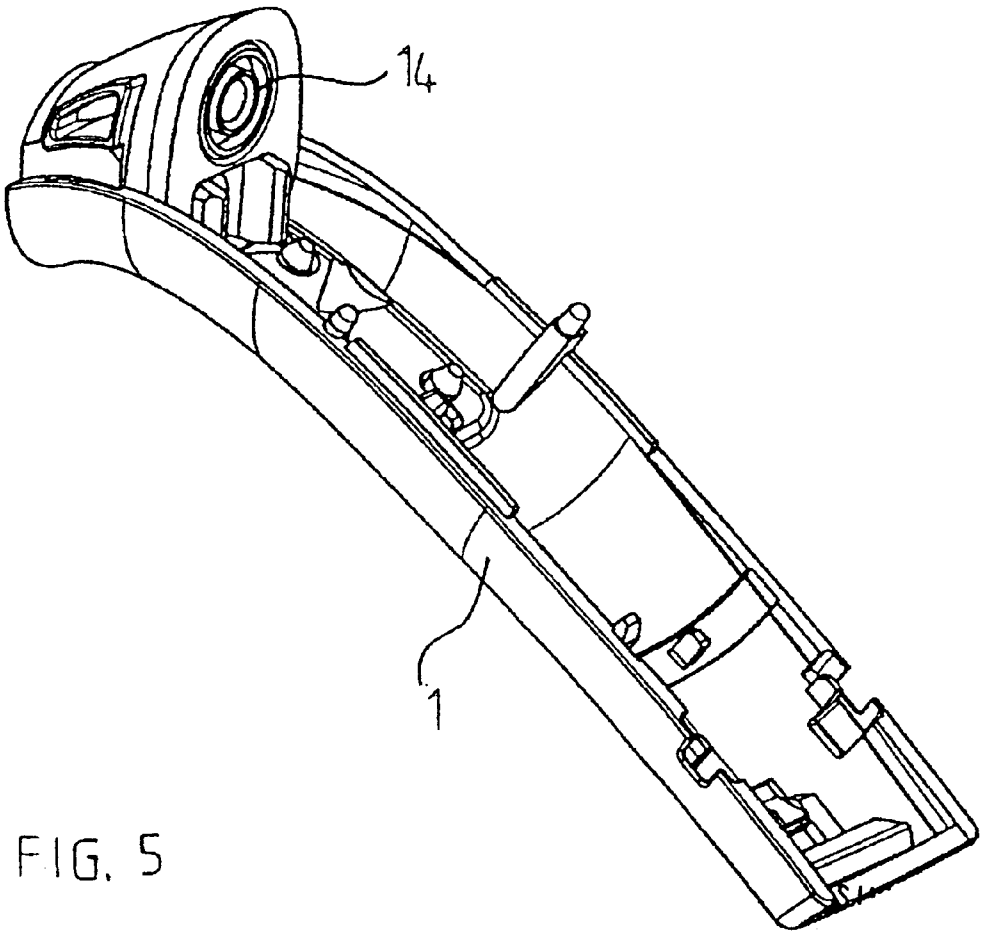
FIGS. 5–11 are perspective views of the front part of the housing during the assembling process.
Figure 6:
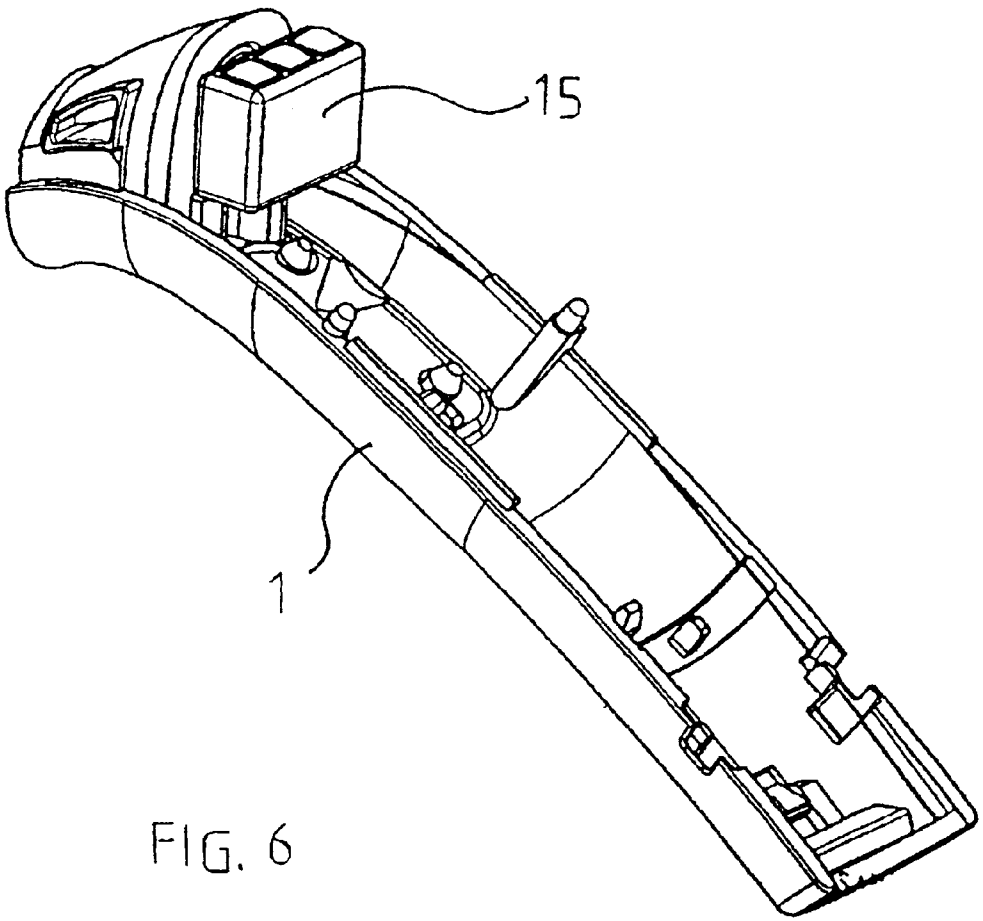
Figure 7:
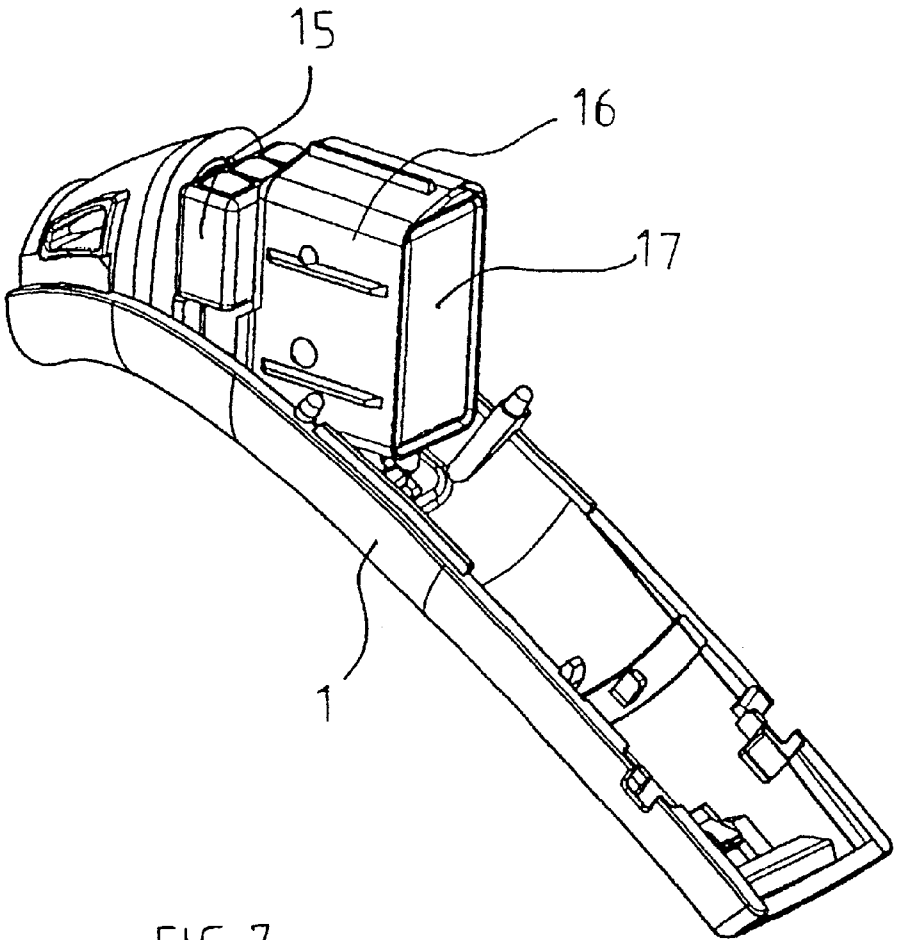
Figure 8:
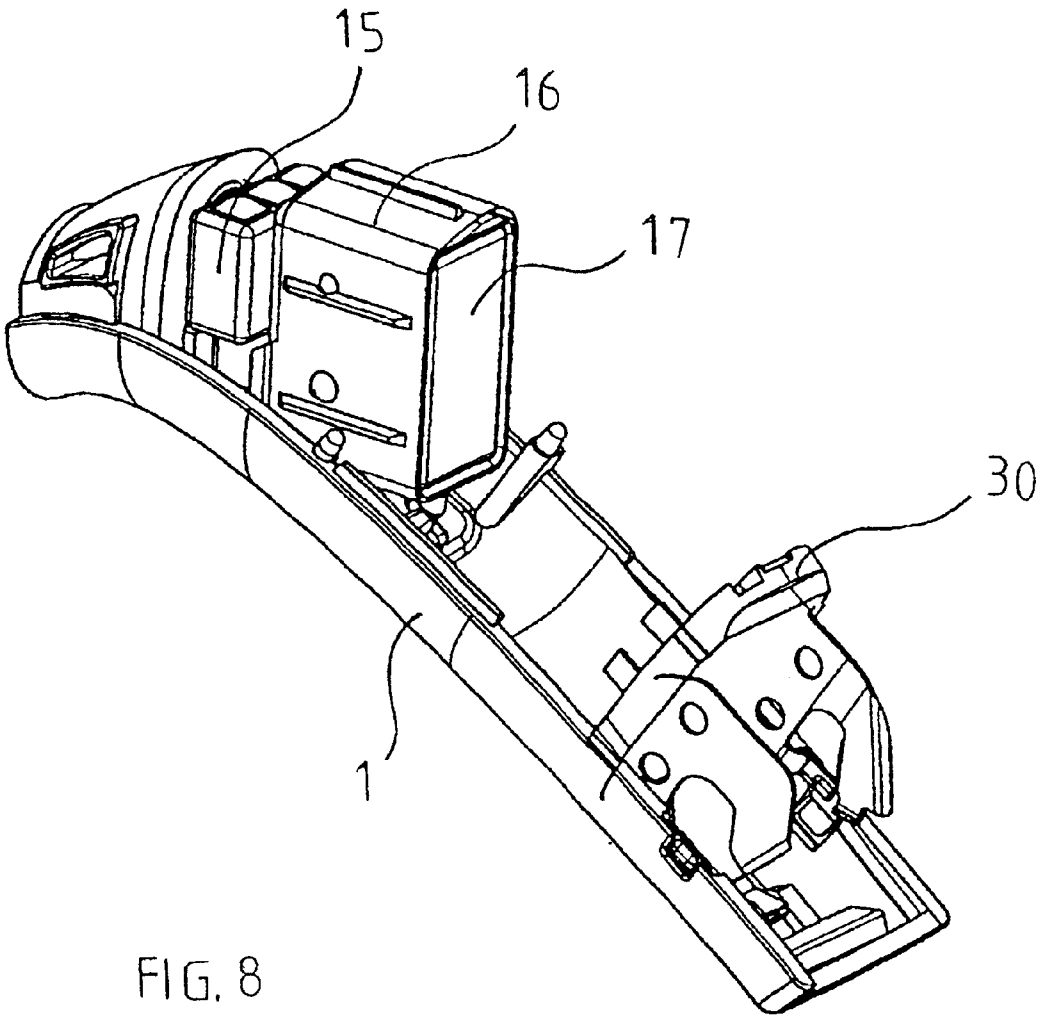
Figure 9:
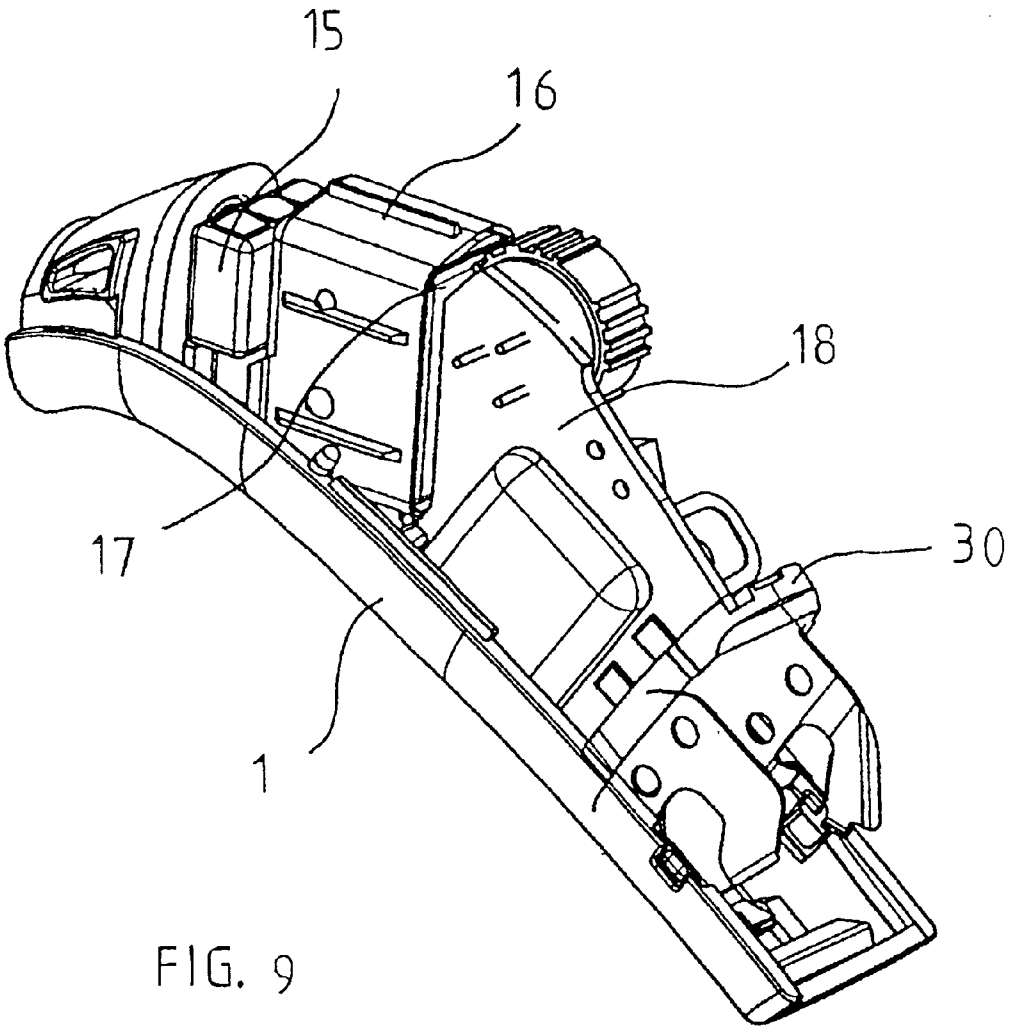
Figure 10:
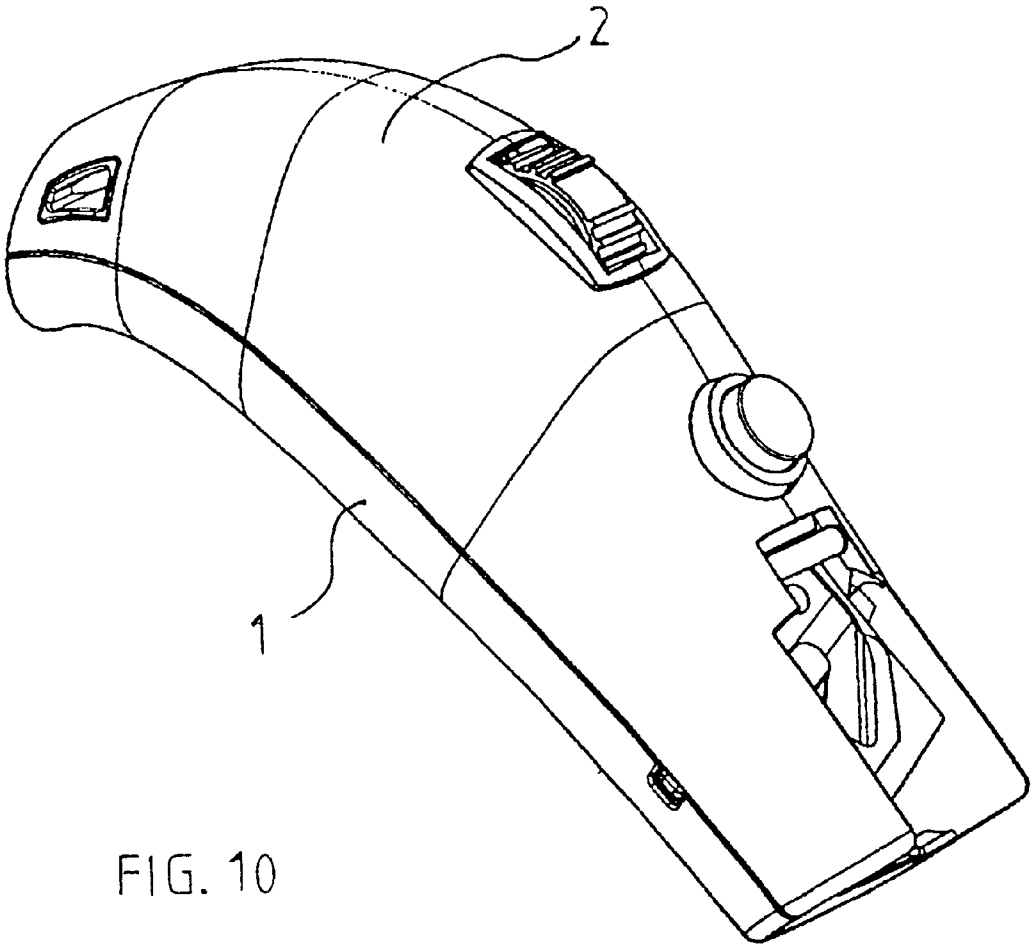
Figure 11:
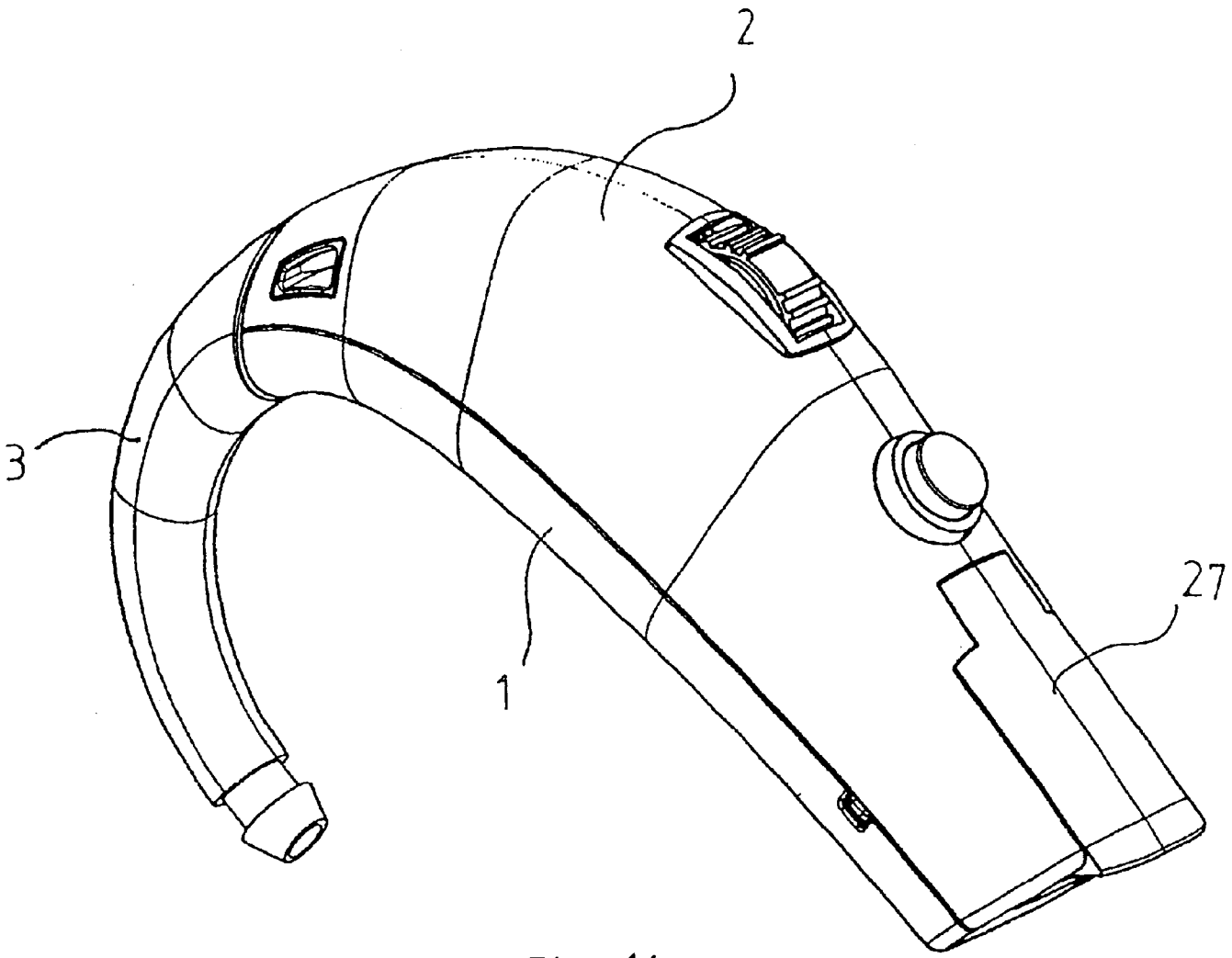

The assembling of the hearing aid is carried out by fixing the first shell part and hereafter placing the microphone suspension in the aperture adapted for this purpose, as shown in FIG. 5. Afterwards the microphone is placed in the microphone suspension as shown in FIG. 6. The receiver suspension is mounted and the receiver is mounted in the receiver suspension as shown in FIG. 7. Following that the terminal wall is mounted in the first shell part, as shown in FIG. 8, and the circuitry board is inserted, as shown in FIG. 9. The electrical connection between the circuitry board and the terminals is achieved by abutment of the free ends of the terminals with contact pads on the circuitry board. Afterwards the second shell part is mounted on the first shell part by snap locking as shown in FIG. 10. The battery drawer is mounted in the second shell part and the hook is mounted in the housing a shown in FIG. 11.

The hearing aid described in the foregoing may be assembled at least partly in automated manufacturing equipment comprising one or more robots. This will significantly reduce the labor intensive manufacturing process, which is normally used in the hearing aid manufacturing. Even when not using robots the construction of the hearing aid as described in the foregoing provides a significant reduction in the manual assembling process.

What is claimed is:

1. A hearing aid comprising a housing which defines a top area, a bottom area, a front area and a rear area and is formed of a first shell part and a second shell part, said first and second shell parts being detachably connected, along lines of separation extending at least partly between said top and bottom areas and along lateral sides of said housing between said front and rear areas, said first and second shell parts defining respective internal slots which are aligned along a plane, a microphone mounted within said housing, a receiver mounted within said housing, a means connected to said housing for containing a battery, an amplifier mounted within said housing, said amplifier including a circuit board which fits within said slots defined by said first and second shell parts, and a hook attached to said top area of said housing for transmitting acoustic signals from the receiver into an ear of a user.

2. A hearing aid according to claim 1, including means in one of said first and second shell parts for holding the microphone.

3. A hearing aid according claim 2, wherein said means for holding the microphone comprise a microphone suspension.

4. A hearing aid according to claim 1, including means in one of said first and second shell parts for holding the receiver.

5. A hearing aid according to claim 4, wherein said means for holding the receiver comprises a receiver suspension.

6. A hearing aid according to claim 1, wherein at least one of the amplifier, the circuitry board, the microphone and the receiver is received in the first shell part.

* * * * *